US006117548A

United States Patent [19]

Swers et al.

[11] Patent Number: 6,117,548

[45] Date of Patent: Sep. 12, 2000

[54] SELF-COATING COMPOSITE STABILIZING YARN

[75] Inventors: David N. Swers, Chapel Hill, N.C.; Johnny E. Parrish, Anderson, S.C.

[73] Assignee: Glen Raven Mills, Inc., Glen Raven, N.C.

[21] Appl. No.: 09/216,516

[22] Filed: Dec. 18, 1998

[51] Int. Cl.[7] ..... D01F 3/00

[52] U.S. Cl. ..... 428/370; 428/95

[58] Field of Search ..... 428/95, 370, 373; 139/383 R, 420 R

[56] References Cited

U.S. PATENT DOCUMENTS

| | | | |
|---|---|---|---|
| 4,080,777 | 3/1978 | Griset, Jr. | 57/140 |
| 4,160,057 | 7/1979 | Kogan et al. | 428/245 |
| 4,212,152 | 7/1980 | Roman | 57/207 |
| 4,276,348 | 6/1981 | Wu et al. | 428/373 |
| 4,406,310 | 9/1983 | Reader et al. | 139/420 R |
| 4,430,852 | 2/1984 | Hatcher | 57/247 |
| 4,534,164 | 8/1985 | Toshimasa et al. | 57/290 |
| 4,830,907 | 5/1989 | Sawyer et al. | 428/225 |
| 4,839,228 | 6/1989 | Jezic et al. | 428/401 |
| 5,104,703 | 4/1992 | Rachman et al. | 428/35.6 |
| 5,192,601 | 3/1993 | Neisler | 428/120 |
| 5,271,992 | 12/1993 | Siener, Jr. et al. | 428/204 |
| 5,305,813 | 4/1994 | Poole | 160/236 |
| 5,397,622 | 3/1995 | Thomas | 428/192 |
| 5,454,142 | 10/1995 | Neely et al. | 28/104 |
| 5,464,684 | 11/1995 | Vogelsang et al. | 428/229 |
| 5,536,551 | 7/1996 | Woosley | 428/92 |
| 5,651,168 | 7/1997 | Tung et al. | 28/220 |
| 5,721,179 | 2/1998 | Shi et al. | 442/203 |

FOREIGN PATENT DOCUMENTS

| | | | |
|---|---|---|---|
| 629724 | 11/1995 | European Pat. Off. . | |
| 816544 | 2/1998 | European Pat. Off. | D03D 15/00 |

*Primary Examiner*—N. Edwards
*Attorney, Agent, or Firm*—Rhodes, Coats & Bennett, L.L.P.

[57] ABSTRACT

A self-coating stabilizing yarn for use with conventional effect yarns in the construction of outdoor fabrics. The self-coating yarn includes a low melt constituent and a high melt constituent. After being woven with the effect yarns and exposed to a pre-selected heating temperature, the low melt constituent melts, flows through the fibers or filaments of the stabilizing yarns and onto the adjacent effect yarn, thus firming bonds and stabilizing and strengthening both the stabilizing yarns, the effect yarns, and the resulting fabric.

6 Claims, 1 Drawing Sheet

SELF-COATING COMPOSITE STABILIZING YARN

FIELD OF THE INVENTION

The present invention relates to yarns used for outdoor fabrics. More particularly, the invention relates to a compounded or composite self-coating yarn which, when combined with other effect yarns, are capable of stabilizing and strengthening such fabrics without the use of a latex back coating or other topical treatments.

BACKGROUND OF THE INVENTION

Compounded or composite yarns formed of high melt and low melt fibers or filaments are generally known for various applications. Examples of such yarns are described in U.S. Pat. Nos. 5,651,168; 5,397,622; and 5,536,551. None of the above yarns, however, are appropriate for or intended for use as a stabilizing yarn for outdoor applications requiring a high degree of dimensional stability, and strength. The term "outdoor fabrics" as used herein is defined as fabric for awnings, tents, sling fabric for furniture, cushions, umbrellas, marine applications, convertible tops, and the like. The term "effect yarn" is intended to mean yarns, such as acrylics, polyester, and polypropylene, which are used in the construction of aesthetically appealing, softer blend decorative fabrics.

Many yarns are inappropriate for outdoor use unless they are solution dyed and UV stable. Such yarns include acrylics, polyester, nylon, and polypropylene. The aforementioned yarns are not considered to be particularly dimensionally stable nor resistant to abrasion in open weave structures to the extent that, in use, they are either provided with a latex backing to improve stability or they have been used with the recognized deficiencies.

Thus, there is a need for a stabilizing yarn suitable for use with effect yarns in the fabrication of open weave fabrics to be utilized in outdoor applications wherein such fabrics will be imparted with improved abrasion resistance, weave stability, strength and the other characteristics described hereinabove.

Use of a latex backing is a recognized impediment to the use and acceptance of fabrics in outdoor applications. The application of a latex backing is expensive, requiring specialized machinery, additional chemical cost and, at times, slower tenter speeds or multiple passes through the tentering operation. It also provides a greater opportunity for mildew problems and renders a stiffer fabric with only one side available for decorative patterning.

SUMMARY OF THE INVENTION

The present invention, therefore, is directed to a novel composite or compounded stabilizing yarn intended for use with effect yarns to fabricate an open weave fabric structure, or, when used in more tightly woven fabrics result in a fabric appearing and feeling to be heavier than it actually is. Outdoor fabrics which include as a component the yarns of the present invention achieve strength and dimensional stability without being heavy and/or tightly woven. By use of the novel stabilizing yarn of the present invention, a better hand is imparted and the resulting fabrics are made to "feel" heavier than they actually are. The stabilizing yarn includes a coating constituent which provides the resulting fabric with superior weave stability, abrasion resistance and esthetic characteristics or properties without the need for latex back coatings. Wicking capability is another important characteristic for quick drying after exposure to water or other liquids.

The yarn of the present invention, therefore, is a self-coating composite stabilizing yarn having low melt constituent and high melt constituent. The low and high melt constituents are intermingled in one of several yarn forming operations to provide a composite or compounded yarn having a denier in the range of 400 to 4,000 or equivalent yarn count. By "low melt" the present invention envisions a constituent having a melt temperature in the range of 240° F. and 280° F. On the other hand, the "high melt" constituent is intended to be defined by a fiber or filament having a melt temperature of 280° F.–340° F. or even greater. Stated otherwise the high melt constituent should have a melt temperature of at least 40–60° F. above that of the low melt constituent. The composite or compounded yarn may be formed in various ways. In one way a continuous filament low melt core yarn can be combined with one or more ends of a continuous filament high melt outer effect yarn with the filament ends being combined during a texturing operation, such as air jet texturing, false twist texturing, twisting, prior twisting, conventional covering and the like. In a second approach, low melt and high melt staple fibers may be homogeneously mixed or blended, then processed according to standard staple yarn processing techniques.

The resulting yarn becomes self-coating and self-bonding in that the low melt constituent or component melts during a subsequent heat operation after fabric formation. Melted polymer then flows through the adjacent fibers or filaments and onto the adjacent effect yarns to bind the individual fabric components together. This makes for a stronger yarn. Further, the individual fabric yarns are fixed in place and thereby the fabric structure is stabilized. The melting of the low melt constituent minimizes raveling, and seam slippage, imparts greater load elongation recovery, and greater abrasion resistance, and all without the application of a conventional latex backing. Since the latex backing can be eliminated, the resulting fabric is more esthetically acceptable with the color pattern of the yarns being visible on both sides of the fabric. Further, in printing applications, the fabric may be printed on both sides. In a continuous lay down operation for pattern cutting, the fabric is folded exposing alternate sides in the finished product, and therefore the latex backing will not permit this technique.

These and other aspects of the present invention will become parent to those skilled in the art after reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of the specification, illustrative two embodiments of the invention and, together with the description, serve to explain the principles of the invention.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DESCRIPTION OF THE PREFERRED EMBODIMENTS

Figure 2:
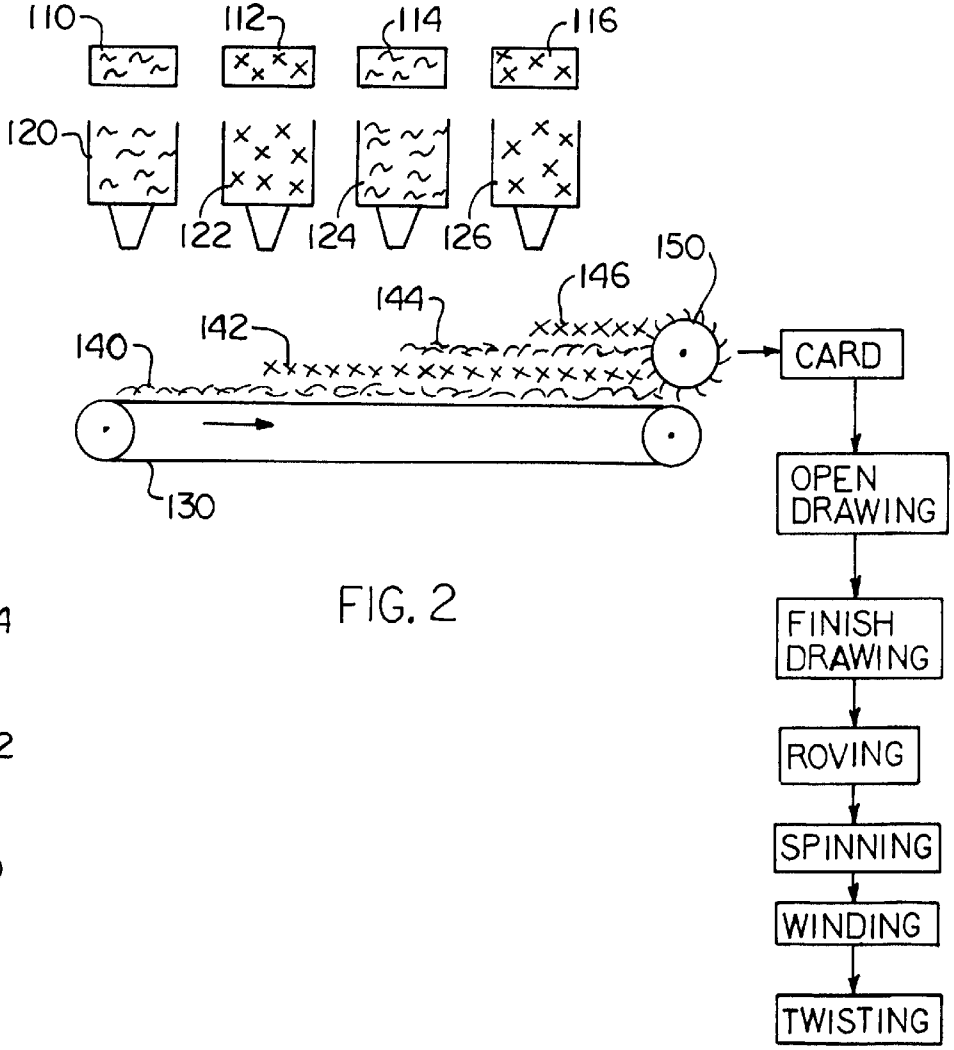
FIG. 2 Is an illustration in which low melt and high melt fibers are blended, then processed according to standard processing to form a blended yarn.
Figure 1:
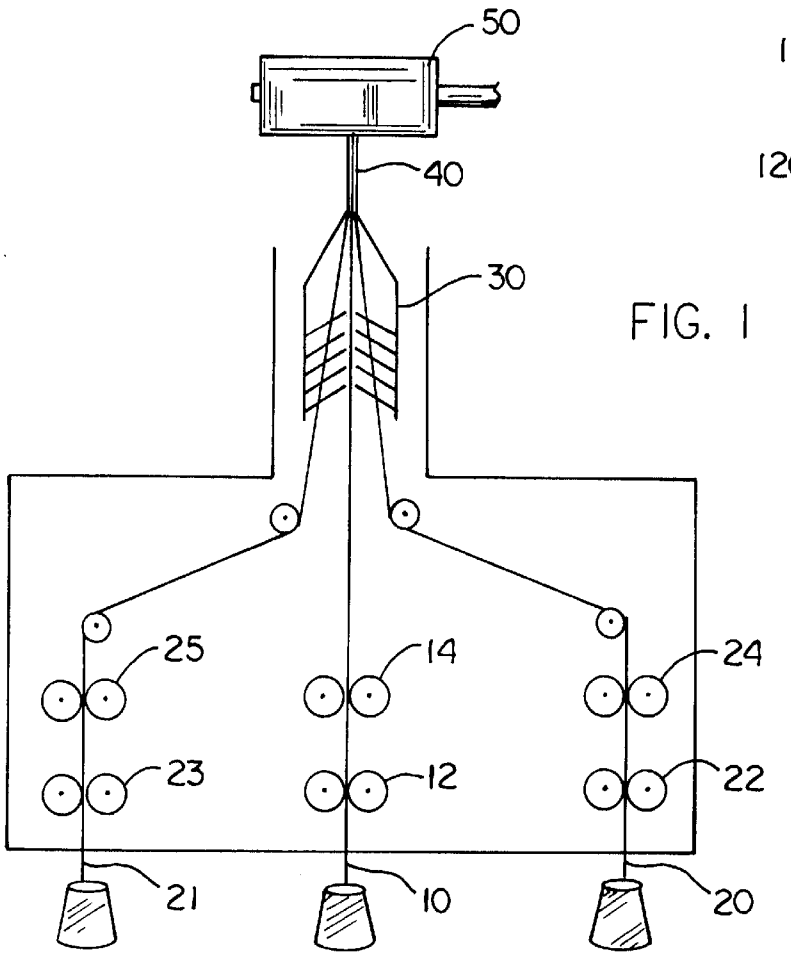
FIG. 1 Is a representation of the processing of a composite yarn in which a continuous filament core is delivered with one or more continuous effect filaments and subjected to an air texturing operation.

The self-coating composite yarn of the present invention may be formed in accordance with FIG. 1 or FIG. 2. In general, such composite yarns include both low melt and high melt constituents. The term "low melt" constituent is intended to mean fibers or filaments having a melt temperature below the temperature of the eventual tentering operation and generally in the range of 240–280° F. The term "high melt" constituent is intended to mean fibers or filaments having a melt temperature at least 40° F.–60° F. higher than the melt temperature of the low melt constituent with which it is intended to be used. Thus, if the ensuing tentering operation is about 290° F., melt temperature of the low melt constituent may be selected at 260° F., and the high melt constituent should be selected to have a melt temperature of about 310°.

Further, the high melt effect yarn is preferably either acrylic, polyester, polypropylene, or nylon while the low melt yarn is preferably polyethylene or polypropylene. The composite yarn with which the present invention is intended includes deniers in the range of 400–4,000 or equivalent yarn counts. By incorporating the self-coating aspect accomplished by use of the low melt constituent, composite yarn itself and the resulting fabric realizes minimal or zero raveling.

Examples of uses of various denier, by way of example include:

400d—open weave, light weight fabrics, i.e. for cushions and shade fabrics

1200d—heavier fabrics such as sling fabric

2400d—even heavier fabrics such as for industrial uses or heavier slings

3700d—heaviest fabrics also for industrial uses

Further, the resulting yarn is extremely abrasion resistant and will meet standards of up to 9,000 double rubs. Such yarns create a fabric that is extremely resistant to slippage. By slippage resistant, it is meant that fabrics formed from such yarns when subjected to an Instron slippage test exhibit an increase in seam slippage from about 20 lbs. in the case of conventionally known fabrics to 40 lbs., and in some instances, even greater than 60 lbs. Also such fabrics formed with the yarns of the present invention will have an increase in load recovery from about 80%, as in the case of conventional fabrics to 95% and better in the case of fabrics formed with the yarns of the present invention.

One way of producing a yarn in accordance with a first embodiment of the invention is illustrated in FIG. 1. One end 10 of a continuous filament low melt yarn, such as polyethylene passes between draw rollers 12, 14 and is introduced into an air texturing zone 30. The low melt, continuous filament end 10 becomes the core yarn of a composite yarn 40 which is ultimately delivered to a take up package 50. Core yarn 10 is drawn between rollers 12 and 14 at a 3 to 1 ratio. The core yarn 10 is, by way of example, selected with a denier of 750, and therefore enters the air texturing zone as a filament having a denier of 250.

Two effect yarns, 20, 21 are drawn from separate packages. Effect yarn 20 is passed between draw rollers 22, 24, while effect yarn is drawn between rollers 23, 25. The effect yarns are drawn at a 1.65 to 1 ratio from an initial denier in the range of 250–5,700 to a final denier in the range of 150–3,500. Resulting compound or composite yarn ranges from a denier of 400 to 4,000. The core yarn is selected from the group consisting of polyethylene, polypropylene and other olefins, whereas the effect yarn is selected from the group consisting of acrylic, polyester, polypropylene and nylon. Other texturing techniques may be utilized though an air texturing process is described hereinabove.

Turning now to a second embodiment, as illustrated in FIG. 2 bales 110, 112, 114, and 116. The bales deliver staple fiber into weigh hoppers 120, 122, 124, and 126 and weigh pans 121, 123, 125, and 127 therebelow. The weigh pans 121, 123, 125, and 127 deliver measured amounts of staple fiber onto a conveyer belt 130 in layers 140, 142, 144, and 146. Finally, the layers are delivered to a card 150 at the end of the conveyer belt where the fibers are homogeneously mixed and aligned during the carding operation. The subsequent conventional processing by drawing, roving, ring spinning, winding, and twisting produce the final compounded yarn.

In order to produce a typical blend of 90% acrylic/10% polyethylene, staple fibers are removed from bales 110, 112, 114, and 116. Each bale will contain one type of fiber. For example, bale 110 would include acrylic, bale 112 polyethylene, bale 114 acrylic, and bale 116 polyethylene. By use of way pans 121, 123, 125 and 127, measured amounts of acrylic and polyethylene would be deposited onto a conveyor. For example, way pans 121 and 123 would be initially set to deliver nine parts of acrylic for each one part of polyethylene. Depending upon the results actually achieved in the initial weighing, weigh pans 125 and 127 could be adjusted to provide a blended sandwich of 90% acrylic and 10% ethylene by weight.

While one technique for producing staple yarn has been illustrated, it is apparent that other techniques are available.

What is claimed is:

1. A self-coating composite yarn for use as a stabilizing and abrasion resistant yarn in outdoor fabrics in which, after the yarns are formed into fabrics and beat treated, certain constituents melt and make the yarn self-coating and self-bonding to other yarns in the fabric, said composite yarn comprising:

a. an acrylic constituent having a melt temperature of at least 280° F.;

b. a polyethylene constituent having a melt temperature no greater than 280° F.;

c. the difference between said polyethylene constituent and said acrylic constituent being greater than 40° F.;

d. said acrylic and polyethylene constituents being staple fibers blended in a prescribed ratio to form said composite yarns;

e. said composite yarn having a denier of about 400–4,000.

2. The self-coating composite yarn according to claim 1 wherein said ratio of acrylic staple fibers to polyethylene staple fibers is approximately 10-1.

3. The self-coating composite yarn according to claim 1 having minimal or zero raveling.

4. A self-coating composite yarn for use as a stabilizing and abrasion resistant yarn in outdoor fabrics in which, after the yarns are formed into fabrics and heat-treated, certain constituents become self-coating and self-bonding to other yarns in the fabric, said composite yarn comprising;

a. a polypropylene high melt constituent having a melt temperature of at least 280° F.;

b. a polyethylene having a low melt constituent having a melt temperature no greater than 280° F.;

c. the difference between said polyethylene constituent and said polypropylene constituent being greater than 40° d. said polypropylene and polyethylene constituents being in tie form of continuous filamentary yarns, said high melt polypropylene yarn and said low melt polyethylene yarn being air textured into said self-coating composite yarn.

5. The self-coating composite yarn according to claim 4 wherein said high melt polypropylene and said low melt polyethylene are drawn at about a 3-1 ratio during the air texturing operation.

6. The self-coating composite yarn according to claim 5 wherein said polyethylene low melt yarn is initially about 750 denier and each polypropylene yarn has an initial denier in the range of about 250–5,700, whereby after drawing the polyethylene yarn has a denier of about 250 and the polypropylene yarn has a denier in the range of about 150–3,500.

* * * * *